United States Patent [19]

Darter et al.

[11] Patent Number: 4,774,994

[45] Date of Patent: Oct. 4, 1988

[54] METHOD AND APPARATUS FOR DIE FORMING METAL SHEETS AND EXTRUSIONS

[75] Inventors: John L. Darter, St. Charles County; Emmett F. Condon, Glendale; John W. Schomburg, St. Louis County, all of Mo.

[73] Assignee: The United States of America as represented by the Secretary of the Air Force, Washington, D.C.

[21] Appl. No.: 880,246

[22] Filed: Jun. 30, 1986

[51] Int. Cl.[4] ..... B22D 45/00

[52] U.S. Cl. ..... 164/341; 164/342; 249/131

[58] Field of Search ..... 164/129, 137, 322, 339, 164/341, 342; 249/129, 131

[56] References Cited

U.S. PATENT DOCUMENTS

| | | | |
|---|---|---|---|
| 82,037 | 9/1868 | Sangster et al. | 249/131 |
| 782,230 | 2/1905 | Finger | 249/129 |
| 862,521 | 8/1907 | Street | 249/129 |
| 958,459 | 5/1910 | Ames | 72/427 |
| 996,601 | 7/1911 | Ames | 72/478 |
| 2,042,012 | 5/1936 | Lumsden | 76/107 |

FOREIGN PATENT DOCUMENTS

| | | | |
|---|---|---|---|
| 441514 | 3/1927 | Fed. Rep. of Germany | 249/131 |

*Primary Examiner*—Nicholas P. Godici
*Assistant Examiner*—Richard K. Seidel
*Attorney, Agent, or Firm*—Jules J. Morris; Donald J. Singer

[57] ABSTRACT

A method and apparatus for die forming metal sheets and extrusions 20 which utilizes recycleable die blocks 16. The die blocks are cast in an adjustable mold box 12. A pivotable dam member 14 is used to set angles on a surface 16*a* of the cast die blocks. Adjusting the pivotable dam 14 permits the casting of a variety of die blocks for introducing a variety of angled joggles in the metal sheets and extrusions. Relatively low melting temperature material is used for the castings.

5 Claims, 1 Drawing Sheet

METHOD AND APPARATUS FOR DIE FORMING METAL SHEETS AND EXTRUSIONS

STATEMENT OF GOVERNMENT INTEREST

The invention described herein may be manufactured and used by or for the Government for governmental purposes without the payment of any royalty thereon.

TECHNICAL FIELD

This invention relates to dies for metal forming metallic parts and is particularly related to dies required to die form relatively small production runs of parts.

BACKGROUND OF THE INVENTION

Many mechanical and extruded metal parts are die formed in die presses to introduce small changes in angle and direction commonly called joggles. In order to introduce the joggles into relatively thin metallic parts, dies are manufactured that will produce the desired joggle in the metallic part when used with an appropriate die press. These slight angle changes are particularly common in aircraft fuselages. The joggles are required to tie in the aircraft skin and the sheet metal parts or extrusions in a manner that produces a level surface. Simply stated, steps are required in cetain metal elements to facilitate crossovers and attachment points.

The tooling required to meet all aircraft requirements of this nature is often very expensive. This is because typical aircraft production often requires that a relatively small number of parts be manufactured at any one time.

Conventionally, dies are machined to fit the requirements of introducing joggles into the required parts. Conventional dies are manufactured from hard tool steel or similar hard material that is expensive to machine. The machining cost for the large number of dies required to satisfy the aircraft requirements can be far more costly than the actual manufacture of the aircraft parts themselves. In addition, the dies, or tooling, must be stored, because of their great aggregate cost, for any future possible production runs. This has resulted in large amounts of tooling being stored for long periods of time at relatively high cost.

It is an object of this invention therefore to provide a method and apparatus for die forming metal sheets and extrusions which greatly reduces tooling costs.

It is a further object of this invention to eliminate the need for storage of large numbers of unique dies.

BRIEF SUMMARY OF THE INVENTION

The invention comprises an apparatus for die forming metal sheets and extrusions which utilizes die blocks of low melting temperature metallic material. The die blocks are formed in an adjustable mold which comprises a mold box, a pivotable dam within the mold box and locking means for locking the pivotable dam member in a desired angular position. Once a desired die block angle is ascertained for a particular joggle, the pivotable member of the mold box is adjusted to produce the desired angle in the die casting made in the mold box.

A matched set of two or four die blocks can be cast in a single mold box. Die blocks, or as they are commonly called joggle blocks, are cast of kirksite type material or other alloys that are sufficiently hard when solidified to be used repeatedly in a die press. The die blocks can later be melted down and recast.

In the preferred embodiment of the invention the pivotable dam comprises a variable angle surface generator having a pivot bar seated in an internal slot and clamping means to lock the position of the pivotable member during casting. The pivotable member is seated inside the mold box and the pivot bar and clamping means are affixed to the mold box.

In another aspect of the preferred embodiment the mold box comprises keyway forming elements for casting keyways onto the die blocks. The cast keyways are unaffected by the angle of the variable angle surface generator. These keyways facilitate precise installation of the die blocks onto a die press.

BRIEF DESCRIPTION OF THE DRAWINGS

The foregoing and other objects and advantages of the invention will be apparent from the following more particular description of the preferred embodiment of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE INVENTION

Figure 1:
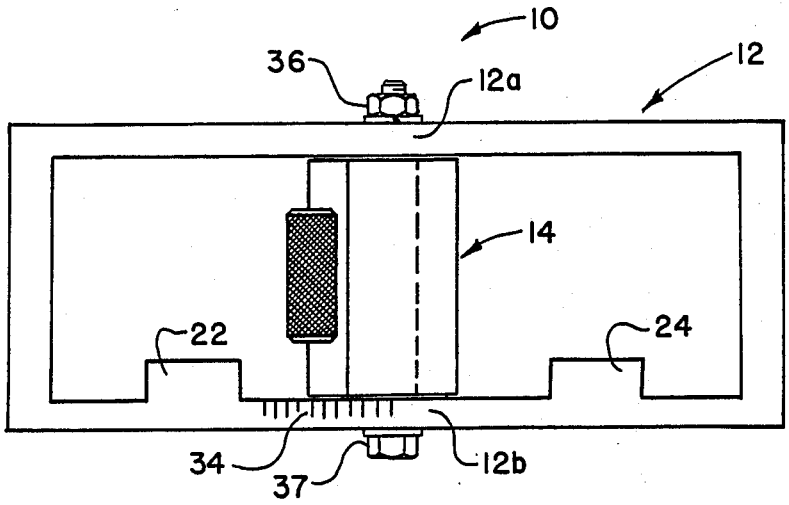
FIG. 1 is a top view of an adjustable mold box for casting reuseable die blocks.
Figure 2:
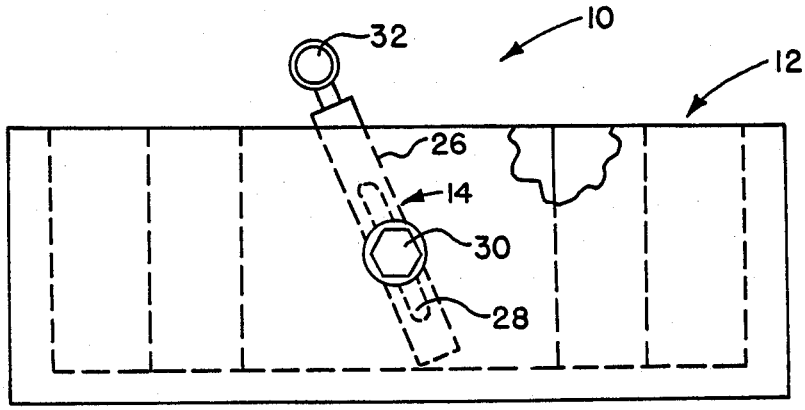
FIG. 2 is a side view of the mold box of FIG. 1 in which the interior of the box is shown in dotted lines.
Figure 3:
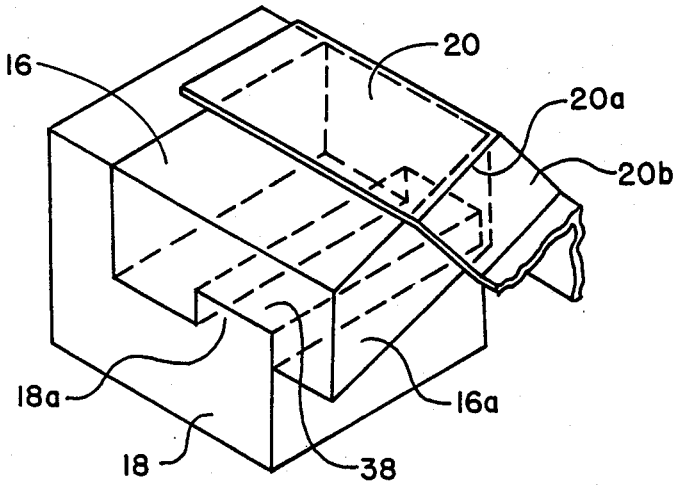
FIG. 3 is an isometric projection of a die block mounted in a die press (partially shown) for forming metal parts.

The invention comprises a method and apparatus for manufacture and use of recycleable die blocks in the fabrication of sheet metal and extruded details. FIGS. 1 and 2 show a mold 10 having a variably angled surface for casting recycleable die blocks. The mold primarily comprises a mold box 12 and pivotable dam member 14. One of the die blocks cast in the mold 10 is shown in FIG. 3. The die block 16 is mounted to a portion of a die press and used for forming details on metal part 20.

The mold shown in FIGS. 1 and 2 comprises a mold box 12 which is used to retain and form liquid casting material. The casting material is divided into two matching die blocks by the pivotable dam member 14. Each of the die blocks has an integral keyway formed by keyway forming ridges 22 and 24. The die blocks are formed with reciprocal angled surfaces as a result of the positioning of pivotable dam member 14 which can be most readily seen in the view of FIG. 2.

The pivotable dam member 14 comprises a variable angle surface generator 26 which includes a through slot 28. The through slot allows passage of a pivot bar 30 which passes through the slot 28 and is affixed to the mold box sidewalls **12*a* and 12*b* (FIG. 1). The elongated slot 28 allows for positioning of the variable angle surface generator 26 at a large number of angles within the mold box 12. The angle surface generator 26 has an adjustment handle 32** by which it can be easily moved to various angles within the mold box.

A scale 34 is imprinted on mold box wall **12*b* for comparison to the position of the variable angle surface generator 26**. The scale is used so that the surface generator can be quickly adjusted to desired angles in a repeatable manner.

Clamping means are used to maintain the pivotable dam member 14 in desired positions. Various clamping means could be used with the mold box 12, however, in the view of FIGS. 1 and 2 a clamping nut 36 is shown. The clamping nut 36 is threaded onto pivot bar 30 having bolt head 37 (FIG. 1). The nut 36 is tightened onto pivot bar 30 after the dam member 14 has been adjusted to a desired position. The nut 36 and the bolt head 37 press against the sides of mold box to draw them slightly inward and against surface generator 26 in order to lock the dam 14 into position.

The casting material used in mold box 12 is preferably a recycleable metallic material with a relatively low melting temperature. The desired materials should have melting temperatures at or above 350° F. in order to be suitable for non-destructive use in a machine shop environment. Lead and antimony are typical low melting temperature metals, however they do not have sufficient strength for use as dies. Harder alloy materials such as those formed from a mixture of one of the above materials and aluminum are therefore preferred.

A particularly preferred material of this type is kirksite. The kirksite or equivalent material is poured into the mold 12 to form two matched die blocks. In instances where T-shaped details are to be die pressed, the die blocks can be divided into a matched set of four. Die blocks manufactured of kirksite can be used to repeatedly bend aluminum parts at temperatures up to 375° without deformation of the die blocks.

Use of these metallic materials has a great advantage over other materials such as chemical setting synthetic casting materials. The metallic materials can be melted down and reused an unlimited number of times. It is therefore possible with the use of adjustable mold box 12 to dispense with storage of joggle block dies, since the dies can be quickly cast and recast as needed. If permanent tooling is required for a particular job the joggle blocks can be retained or other non-reusable material can be used as the casting material.

Use of the adjustable mold box and renewable casting material reduces the cost of dies by eliminating the machining of hard tooling. Storage costs associated with hard tooling are also eliminated since dies are recast to suit.

A typical die block 16 is shown installed on a die press adapter 18 in the view of FIG. 3. The adapter 18 typically forms a part of a die press mechanism which presses a part 20 against the die 16 to form a joggle **20*b***.

The die has a keyway 38 (formed by ridges 22 of the mold box) which is used to align and facilitate assembly of the die block to the adapter 18. The adapter 18 has a key **18*a* for insertion into the keyway 38**. Typically a set of these matched die blocks would be used in a conventional die press mechanism.

Angled surface **16*a* of the die block (formed adjacent to the pivotable dam 14) is used to introduce an angled fold 20*a* to part 20 which forms a part of the joggle 20*b*** that is created through use of several die blocks. Joggles of the type shown are often used at aircraft skin and frame attachment points.

During use of the die press, part 20 is supported by a complete set of die blocks so that the part is bent to form the joggle **20*b*. If the part 20 is improperly supported shearing and damage can result. The adjustable mold 10** is capable of casting a matched set of die blocks for use in the die press. This provides die blocks capable of setting joggles at various angles on formed flanges and extruded shapes (angles and tees). The mold is so configured as to provide keyways and working supports compatible with a single set of die press adapters regardless of the angle desired on the die block in order to set the joggle.

It has therefore been shown that the mold is adjustable to set any joggle angles required with a minimum of setup time. Angles can be quickly changed through use of the pivotable dam 14. Further, since the die blocks are recycleable and are easily manufactured, long term storage is eliminated. This results in a great savings in manufacturing costs since the expensive machining of hard tooling for setting joggle angles has been completely eliminated.

While the invention has been particularly described with reference to the preferred embodiment thereof, it will be understood by those skilled in the art that various changes in substance and form can be made therein without having departed from the spirit and the scope of the invention as detailed in the attached claims.

We claim:

1. An apparatus for producing metal forming dies comprising:

(a) a mold box for retaining and forming liquid casting material into two die blocks;

(b) a pivotable dam member for producing an angled surface on each of said two die blocks, wherein said pivotable dam member is positioned within said mold box and comprises a slot and a pivot bar, said pivot bar passes through said slot in said pivotable dam and is affixed to said mold box;

(c) locking means for locking said pivotable dam member in a variety of angled positions; and (d) keyway forming ridges inside said mold box for forming keyways on said two die blocks, said keyways for positioning said die blocks on a metal forming die press.

2. The apparatus of claim 1 wherein said die blocks cast in said mold box are matched with oppositely angled surfaces.

3. The apparatus of claim 1 wherein said locking means comprises a clamp.

4. The apparatus of claim 1 wherein said casting material comprises low melting temperature metallic material.

5. The apparatus of claim 1 wherein said casting material comprises kirksite.

* * * * *